United States Patent [19]

Coester

[11] Patent Number: 4,587,906

[45] Date of Patent: May 13, 1986

[54] PNEUMATIC PROPULSION SYSTEM FOR CAR AND PASSENGER VEHICLES

[76] Inventor: Oskar H. W. Coester, Rua David Francisco Mauricio 85, Porto Alegre, Rio Grande do Sul, Brazil

[21] Appl. No.: 190,926

[22] Filed: Sep. 26, 1980

Related U.S. Application Data

[63] Continuation-in-part of Ser. No. 909,434, May 25, 1978, abandoned.

[30] Foreign Application Priority Data

Sep. 28, 1979 [BR] Brazil ..... 7906255

[51] Int. Cl.[4] ..... B60U 3/04; B61B 13/08

[52] U.S. Cl. ..... 104/156; 104/161

[58] Field of Search ..... 104/156, 155, 157, 158, 104/159, 160, 161, 140, 139, 154, 23 FS, 138 R, 298, 299, 301, 305; 92/88; 244/63; 246/6

[56] References Cited

U.S. PATENT DOCUMENTS

| | | | |
|---|---|---|---|
| 44,376 | 9/1864 | Alison & Halliwell | 104/155 |
| 381,401 | 4/1888 | Mayall | 104/161 |
| 403,729 | 5/1889 | Bodefeld | 104/161 |
| 409,769 | 8/1889 | Bodefeld | 104/161 |
| 680,843 | 8/1901 | Comstock | 104/156 |
| 3,019,813 | 2/1962 | Dommann | 92/88 X |
| 3,438,337 | 4/1969 | Edwards | 104/155 X |
| 3,522,773 | 8/1970 | Edwards | 104/139 X |
| 3,722,424 | 3/1973 | Van Veldhuizen | 104/23 FS |
| 3,771,463 | 11/1973 | Smoot et al. | 104/299 X |
| 3,999,487 | 12/1976 | Valverde | 104/155 X |
| 4,240,599 | 12/1980 | Hammond | 104/156 X |
| 4,266,273 | 5/1981 | Dobler et al. | 246/6 X |

*Primary Examiner*—John J. Love
*Assistant Examiner*—Mitchell J. Hill
*Attorney, Agent, or Firm*—Greene, Callmann & Durr

[57] ABSTRACT

A system for propelling vehicles for carrying passengers or cargo comprises a longitudinal duct, having a slit at the top and a pair of rails or tracks. A vehicle is provided to run on the tracks and has a fin which projects into the duct to substantially fill the same. Differential air pressure is applied to the duct to cause the fin to move along the duct and carry the vehicle with it. The duct may include several stations with means to produce differential air pressure between the separate stations. A braking device operates to apply brakes when the pressure on both sides of the fin is substantially the same. Preferably the vehicle contains no internal control for the fin or air pressure so that it can be controlled from the outside by the device for forwarding the differential air pressure.

4 Claims, 15 Drawing Figures

FIG. 2
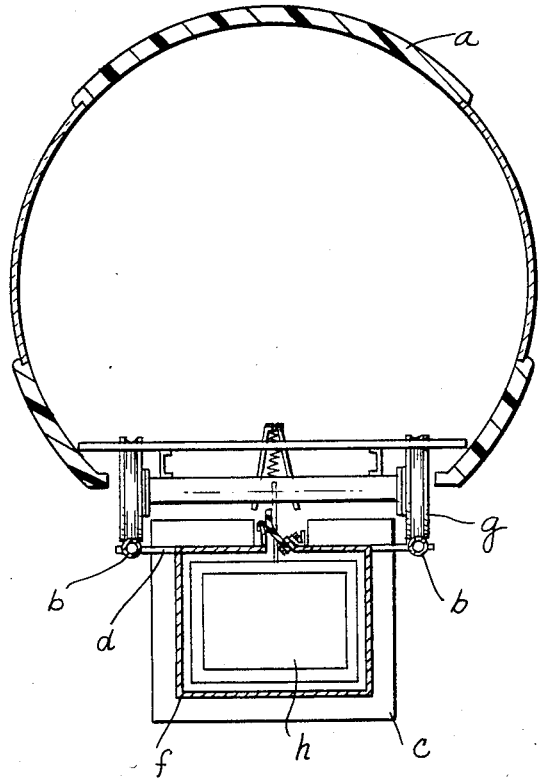
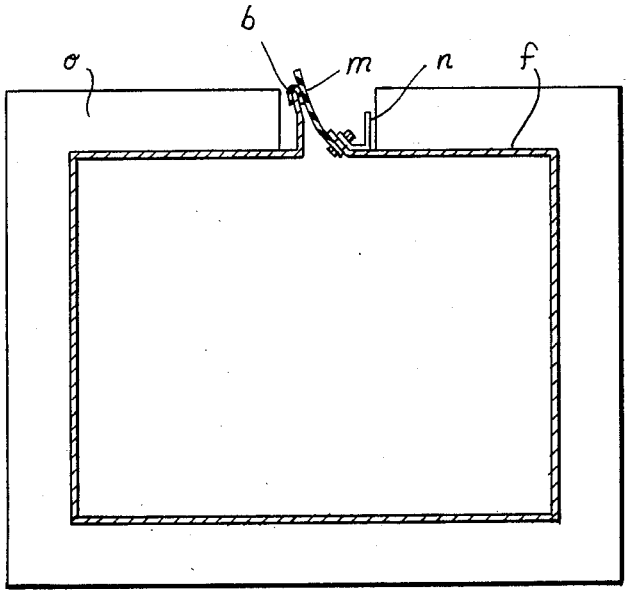
FIG. 4

PNEUMATIC PROPULSION SYSTEM FOR CAR AND PASSENGER VEHICLES

This application is a continuation-in-part of U.S. Application Ser. No. 909,434 filed May 25, 1978.

In that application there is disclosed a pneumatic propulsion system for wheeled cargo or passenger vehicles wherein a tubular air-pressure duct, which is preferably rectangular in cross section with a longitudinal slot along its upper surface, is supported above the ground and the duct in turn holds the tracks on which the vehicle is to run. At least one rod extends from the vehicle, through the slot and supports an adjustable vane or fin which in one position substantially fills the interior area of the duct.

The advantage of such a system consists in that the vehicle can be made of material which is strong but of light weight, as traction between the wheels and the rails to drive the vehicle is not necessary and no component of the propulsion system is installed therein, the vehicle being driven exclusively by an air pressure differential on both sides of the vane, said differential being generated by a stationary unit.

Among the objects of the present invention is to provide a pneumatic propulsion system for vehicles similar to that disclosed in said prior application but having improved driving and control features.

Other objects of the invention will be pointed out in the following description and claims and illustrated in the accompanying drawings, which disclose, by way of example, the principle of the invention and the best mode of applying that principle.

In the drawings:

FIG. 2 is a front cross sectional view taken through the vehicle of FIG. 1.

FIG. 4 is a detail cross sectional view of the duct.

Figure 1:
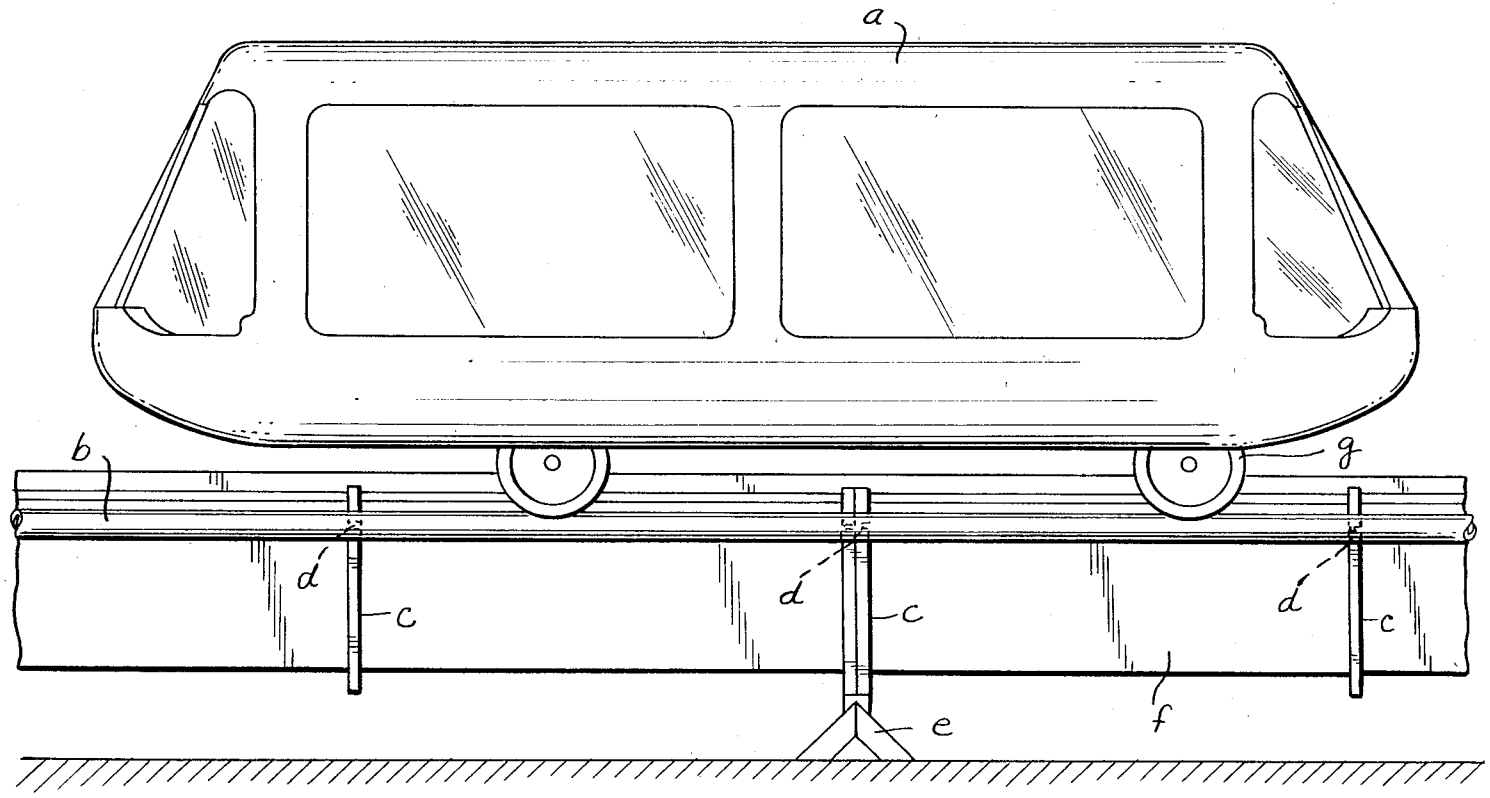
FIG. 1 is a side view of an embodiment of the system showing a vehicle on a track supported on a tubular duct which is supported above ground.

A typical passenger vehicle is shown in FIG. 1 which moves by means of wheels g on a pair of rails b. These track means or rails are positioned on a propulsion duct f by means of props d (see FIG. 2 also) which are rigidly connected to the reinforcement flanges c and to the duct f itself. The duct assemblage or tubular means is elevated at any desired height above the ground, supported at regular intervals by supporting pillars or if desired can be suspended from brackets at regular intervals. As seen in FIG. 2, the vehicle a has a propulsion fin h extending into the duct f. Thus this pneumatic drive transport system wherein the duct f besides canalizing the air to move the vehicle has the additional function of providing the necessary structure for the installation of rails in an aerial network so that the transport system has an exclusive route, without interference with surface traffic.

Figure 3:
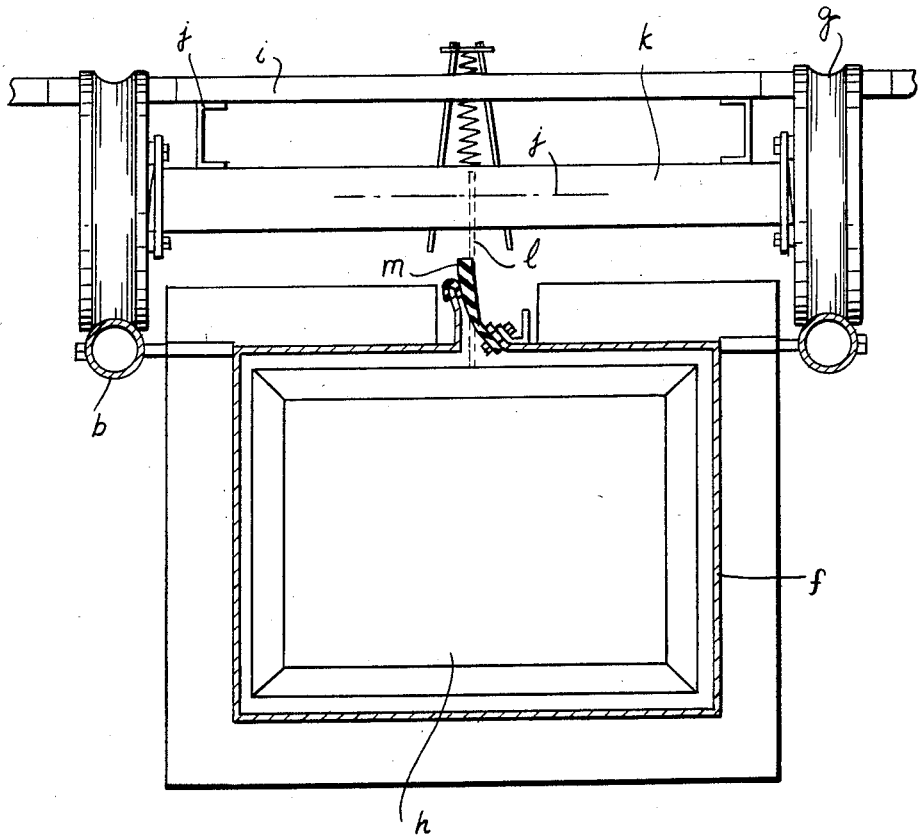
FIG. 3 is an enlarged detail cross sectional view of the duct, propulsion fin, track and wheels of the vehicle.

The body i of the vehicle is supported on a chassis j which includes the axles k for wheels g as shown in FIG. 3. The propelling fin h has the form of a rectangular plate and is fastened to the axle K of vehicle a by means of articulation arm l. The arm l extends from the inside of the duct f to the outside through a longitudinal slit in duct f. The slit in duct f is made substantially air tight by means of a sealing flap m made of flexible material. As shown in more detail in FIG. 4, the reinforcement frame c for the duct f extends up to but is open adjacent the slit in the duct f. The flexible tightening flap m is secured to the duct by means of the angle piece n with a V-shaped cross section in such a manner as to normally press against the longitudinal bumper O connected to the edge of the opening of duct f. When suction is applied to a part of the duct, the difference between internal and external pressure compresses the flexible flap m against the bumper O, thereby providing effective air proofing of the gap between the region where the suction is applied and the region of the fin h. When the duct is supplied with superatmospheric pressure, the flexible flap also effectively seals the slit in as much as the flap is bent and is pressed against the bumper O. At the same time the flexible flap m permits passage of the articulating arm l of the vehicle away from its closed position. If desired the same principle can be employed for superatmospheric pressures, i.e., the flap m can be constructed to curve internally with respect to the duct so as to tighten under superatmospheric pressure. Also a combination of the two types of flexible flaps may be employed.

Figure 5:
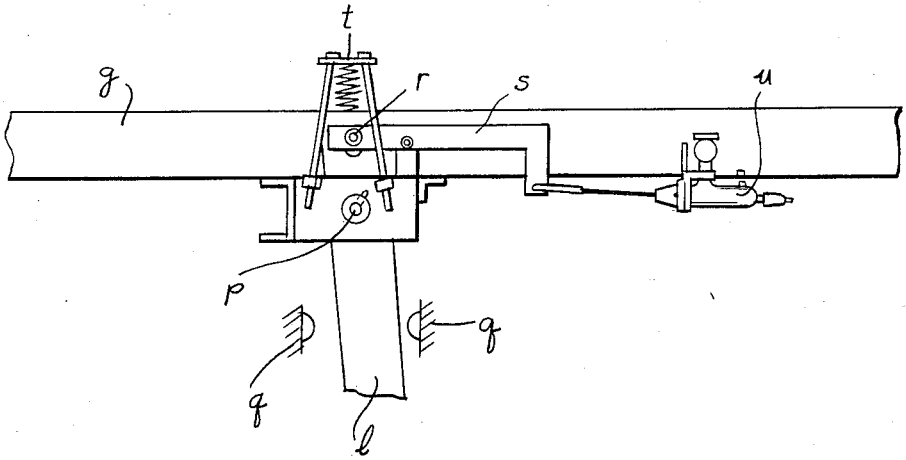
FIG. 5 is a side detail view of the articulating arm of the propulsion fin and the brake system.

As shown in FIG. 5, the articulating arm l is fastened to the vehicle frame by means of pin p, which permits a pivotal movement of the arm between the bumpers q. The position of the arm controls the brake system of the vehicle. A bearing r is positioned adjacent the end of a brake control lever s and is compressed by a spring t against the upper surface of articulating arm l. Said upper surface of the arm l acts as a cam and is so shaped that when the arm l is in the vertical position, the bearing r is in its lowermost position and the brake cylinder is operated by lever s. When arm l is in an extreme position against one of its bumpers q, the bearing rises and control lever s releases the brake system. The bumpers q can be connected to the frame of vehicle a in any desired way. As an alternative to this mechanical system, the fin or a sensor device connected to the fin may be movable in accordance with the pressure conditions in the duct, so as to control an electric circuit which activates the brake cylinder through an electric servomotor as will be described below in connection with FIG. 13.

In operation, when an exhauster is started at an end of the propulsion duct there is an air flow inside the duct, the propulsion fin inside the duct blockades the air flow establishing a pressure differential on either side of the fin and this differential increases up to the limit of performance of the exhauster employed. This pressure difference, acting on the area of the fin, produces a pulling action which is transferred to the vehicle through the articulating arm of the fin but first pivots the fin and arm slightly to release the brake. The braking system is automatic, a safety feature of the system, the brakes being activated whenever the propulsion duct is deactivated, i.e., when there is not pressure differential acting on the propelling fin it goes to neutral position to activate the brake. The cylinder may apply pressure to brakes associated with the wheels of the vehicle in the conventional way. On the other hand, when the duct is activated by an exhauster or pressure means, the pull on the propulsion fin pushes articulating arm 1 forward or backward as shown in FIG. 5 against one of bumpers q and thereby releases the brake of the vehicle. Since the propelling fin h has a blockading surface which remains substantially fixed relative to the air flow in the duct, the pull on this propelling fin is entirely determined by the intensity and direction of the air flow. An important effect of this is that the described vehicle, being passive, can be operated remotely by the variation of the air flow in the propulsion duct. This is especially the case in a propulsion duct containing a flow alternator and a flow control valve to moderate pressure and speed as illustrated in FIGS. 6–10 wherein an operator located at the alternator can stop and brake the vehicle by cutting off air flow in the duct, can release the brake, start and accelerate the vehicle, can maintain or reduce the speed of the vehicle by adjusting the air flow, and can brake and stop the vehicle by cutting off air flow.

A vehicle which has been operated in one direction by a vacuum or by suction can be returned in the opposite direction by air pressure or the vehicles can be operated in both directions by pressure or by suction. Also a kind of command and control of the vehicle may be utilized which is entirely automatic, sensors located along the duct controlling at every moment the position, speed and acceleration of the vehicle through a computer, the air flow being modulated so as to control a preestablished pattern of speeds and acceleration. This pneumatic propulsion transport system permits operation of completely passive vehicles—without requiring either an operator inside the vehicle or the transmission of command to its interior—remotely controlled by operators or by automatic systems which adjust the air flow in the propulsion duct.

Figure 12A:
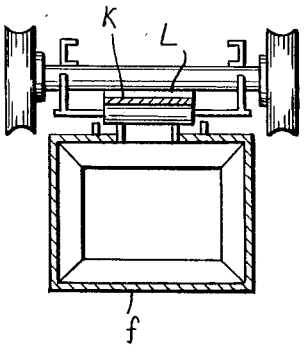
FIG. 12A is a front cross-sectional view of the arrangement of FIG. 12.
Figure 12:
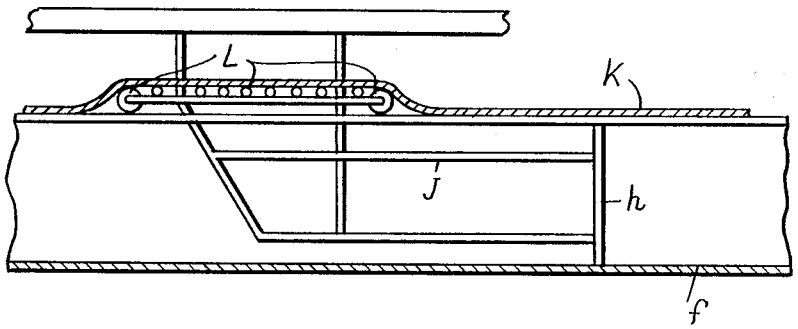
FIG. 12 is a diagrammatic side cross-sectional view of a modified form of propulsion fin and its connection to the frame of a vehicle.

The energy efficiency of the system can be improved by minimizing aerodynamic losses with a duct release system which admits free passage of air into the duct immediately behind the propelling fin of the vehicle, deactivating that portion of the duct already passed over by the vehicle. The pressure release in the duct is carried out through devices fastened to the vehicle and aligned with the fin articulating arm 1 which displace the flexible tightening flap m from its airtight position maintaining an air passage open through the gap for an adequate distance opposite to the side of the fin that is being subject to vacuum or superatmospheric pressure. Another manner of providing a pressure release opening in the gap consists of replacing the flexible flap m of FIGS. 4 and 5 by a flexible mat. Thus in FIG. 12 the fin h moves inside duct f, emptied by a structure J which is fastened to the chassis of the vehicle. The longitudinal gap of the duct is closed with a flexible mat K. Pressure or vacuum is being applied to the right side of fin h as seen in FIG. 12. The rollers L of FIGS. 12 and 12A open the gap to the atmosphere to prevent any buildup in pressure or vacuum back of fin h as a result of the movement of the fin h. Thereby that portion of the duct which is ahead of or to the right of fin h when suction is being applied is closed and fully subjected to the pressure differential provided by the exhauster (not shown) while that portion of the duct which is behind or to the left of fin h is deactivated, without any air flow because air enters through the gap. The same principle applies when superatmospheric pressure is applied to the right hand end of duct f. A similar effect can be obtained by installing valves along the duct which automatically open when the vehicle passes.

Figure 6:
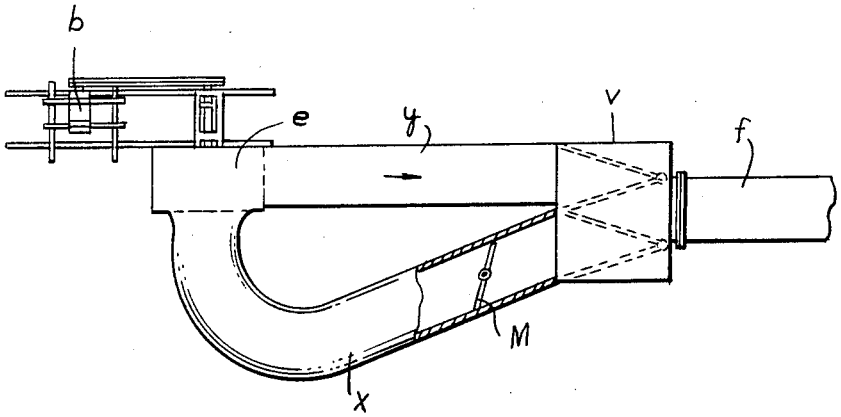
FIG. 6 is a view, somewhat diagrammatic, of an exhaustor and connecting means to the propulsion duct.
Figure 7:
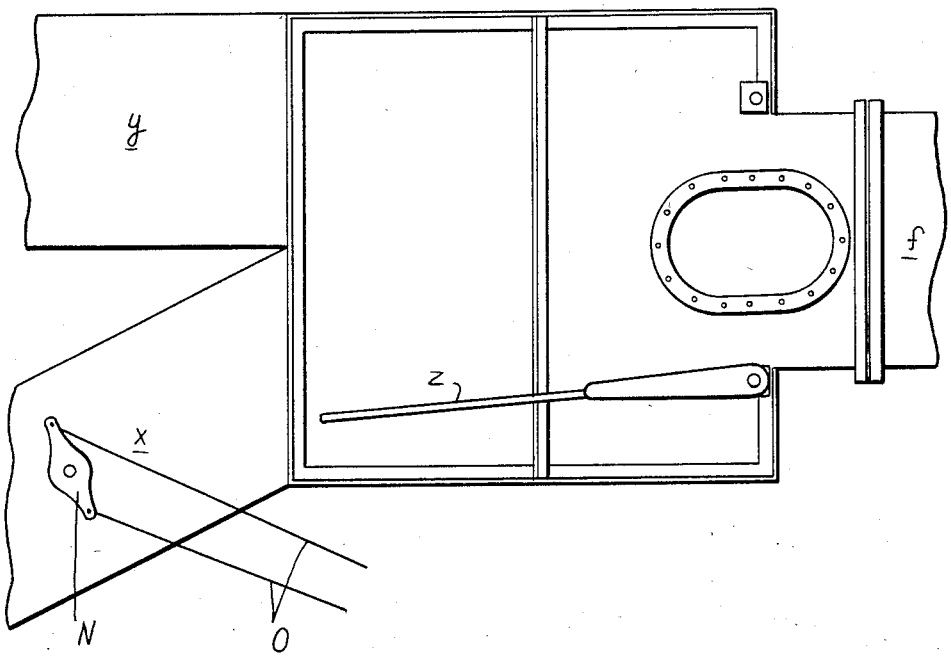
FIG. 7 is an enlarged exterior view of the valve portion of FIG. 6.
Figure 8:
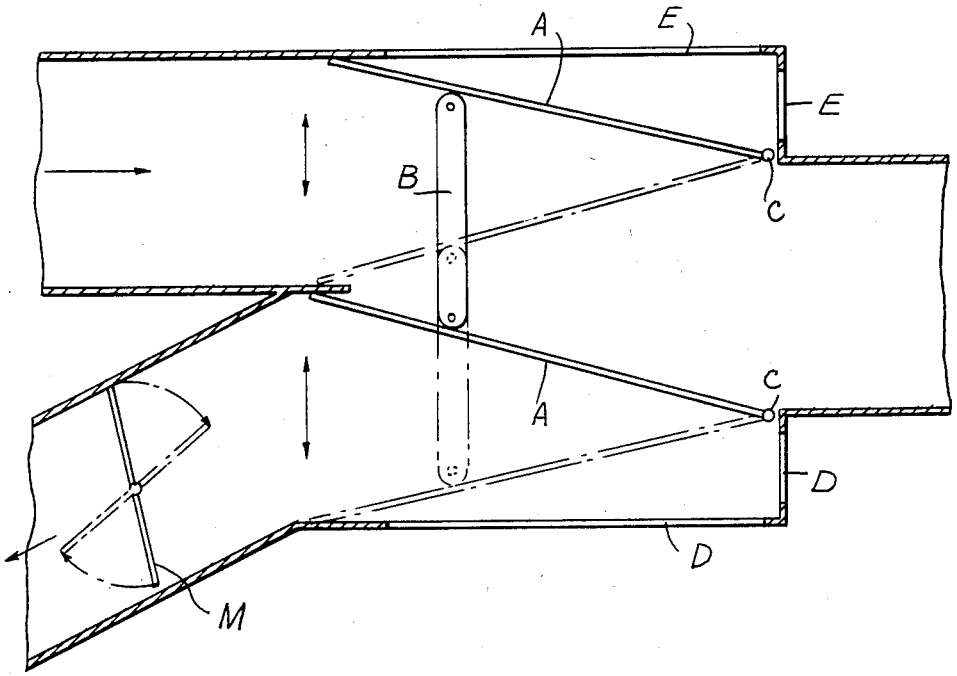
FIG. 8 is an enlarged cross-sectional view of the valve portion of FIG. 6.
Figure 9:
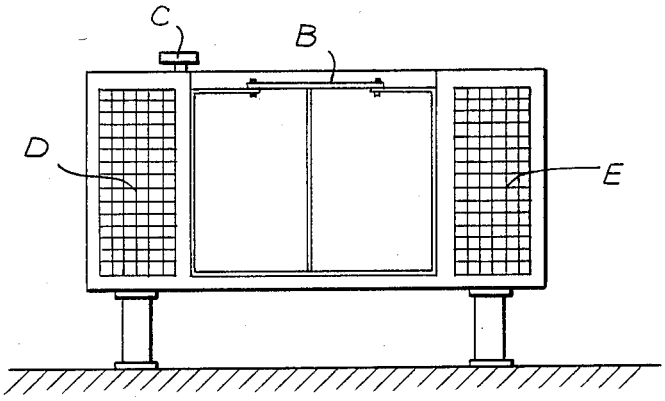
FIG. 9 is a front view, partly in cross section of the part shown in FIG. 6.
Figure 10:
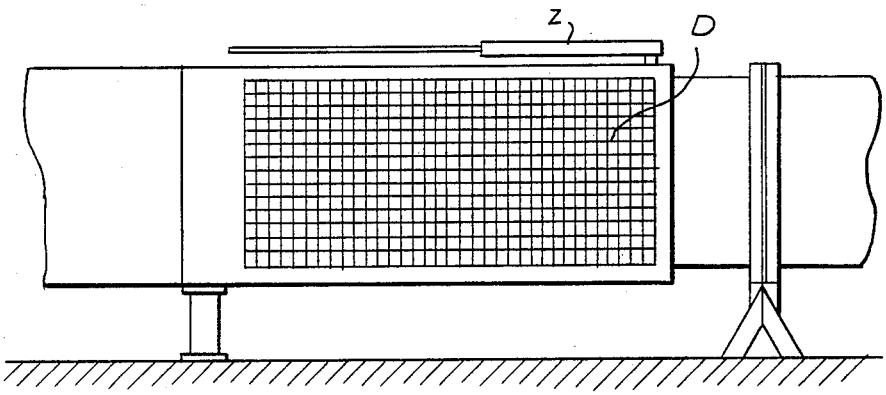
FIG. 10 is a side view of the part shown in FIG. 6.

A suitable air exhauster and/or pressure means is shown in FIGS. 6–8. The centrifugal fan e has an intake duct x and an outlet duct y, both connected to propulsion duct f through a flow alternator or valve v. A flow control valve m is positioned in intake duct x. As shown in FIG. 7 a lever 7 acts on a pair of deflector plates A,A. Also as shown in FIG. 9 a lever N controlled by cables o moves the shaft of flow control valve m. The deflector plates A,A are interconnected through connecting rod B to pivot about shafts C (FIG. 8) through which the driving power may also be transmitted. When the deflector plates are in the position shown in solid lines in FIG. 8, the discharge duct of the exhauster is connected directly to the propulsion duct f while the admission of air to the exhauster is through direct duct x to the openings D therein. When the pair of deflecting plates A,A is moved to the position shown in broken lines of FIG. 8, the intake duct of the exhauster connects directly with the propulsion duct f while the exhauster discharge is through duct y and openings E therein. The flow control valve M can be pivoted from a position transverse to the duct x where the duct is completely closed to a position parallel to the duct permitting maximum flow. As shown in FIGS. 9 and 10 the openings D and E are covered by a strainer mesh and the position of the deflector plates A,A is controlled by the lever Z. When operating the pneumatic propulsion transport system, the combination of the flow control valve with the flow alternator described above provides the choice of any rate of pressure or suction within the propulsion duct, within the limits of the performance of the exhauster itself. Thus when the deflector plates A,A are moved to the position shown in broken lines, a rate of suction and outflow towards the exhauster is established. When the deflector plates A,A are moved to the position shown in solid lines, a rate of superatmospheric pressure and air flow away from the exhauster is established. Under both pressure rates, the angular flow control valve M permits the operator to control the rate of flow. Thus the operator may totally interrupt the air flow in the duct f, insulating the exhauster by completely closing the flow control valve M. This can be done whenever there is a stop; by closing the valve M the exhauster will be running idle with a minimum of power consumption. In other words, the installation of a flow alternator A,A and a flow control valve M between the exhauster and the propulsion duct f permits modulation of the pressure and air outflow rate in duct f by an operator at a remote position from the vehicle, e.g. at one of the stations. This modulation may be carried out by an automatic system, wherein e.g. a computer determines the position of deflector plates A,A and valve M in accordance with a preestablished program of speeds and acceleration and/or in response to information transmitted by sensors installed along the route, as has been done in railroad transportation systems.

Figure 11:
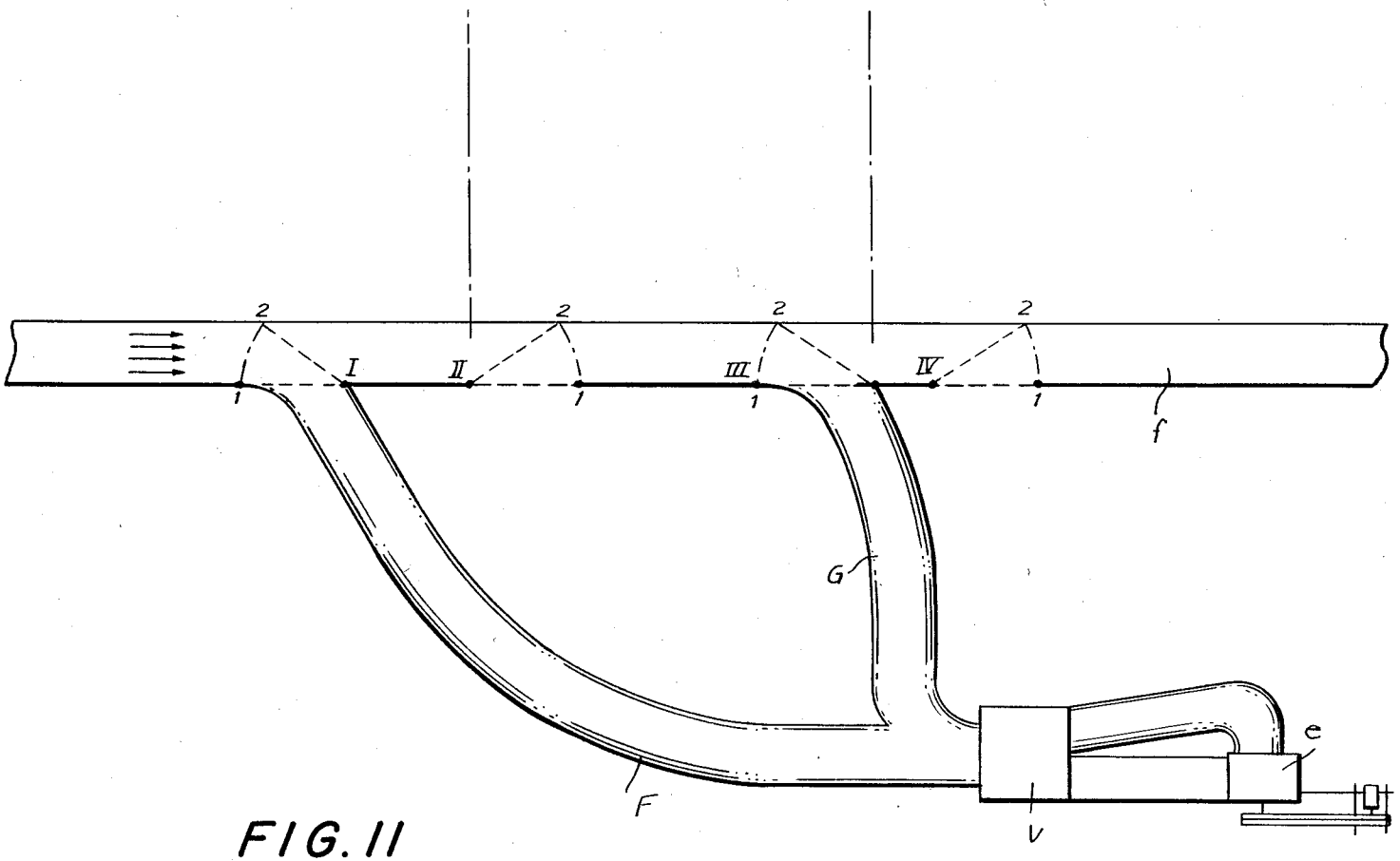
FIG. 11 is diagrammatic illustration of a valve arrangement at a station for the vehicle.

As illustrated in FIG. 11, a station typical of the invention may include the exhauster e, valve device V, and flow control valve M (not shown) is connected to the propulsion duct f through two ducts F and G. Valves I and III are provided to insulate ducts F & G from the propulsion duct f. The propulsion duct f also includes release valves II and IV. A transportation system according to the invention can include a series of stretches with a station at the end of each stretch which includes an exhauster.

Figure 13:
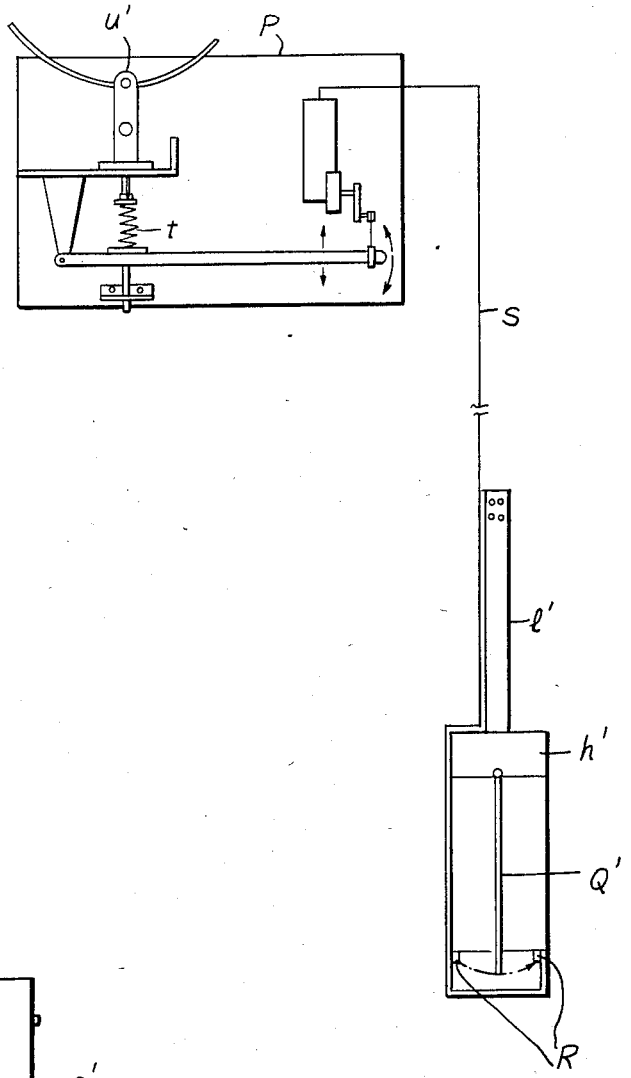
FIG. 13 shows a modified form of brake mechanism cooperating with a modified form of fin.
Figure 13A:
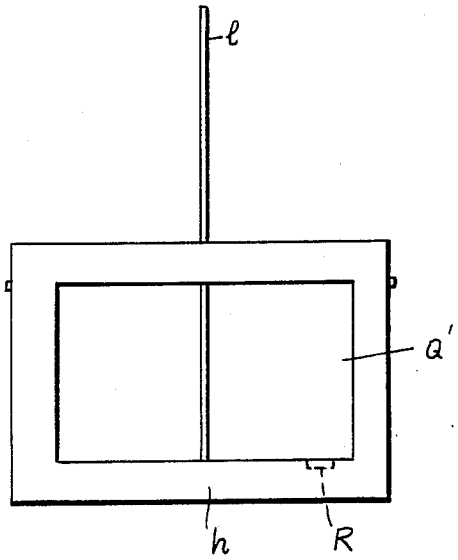
FIG. 13A is a front view of the modified form of fin of FIG. 13.

In FIGS. 13 and 13A, the fin h″ has an open box-like form and includes a pivotal fin Q′. The main fin h′ is rigid but under a pressure differential the pivotal fin Q′ moves into contact with one or the other electrical contacts R completing a circuit S to a servomotor P which operates the air brake cylinder U′. Thus we have the following operating cycle.

1. A vehicle a is moving on a first stretch of the system toward the station of FIG. 11, where the flow alternator V is positioned for suction, the flow control valve M is in open position, valve I is closed (position 2), valve II is open (position 1), valve III is open (position 1) and valve IV is open (position 1). An exhauster located downstream from the station of FIG. 11 can move by suction a vehicle which has previously stopped at FIG. 11, moving the vehicle along the second stretch of the system when valve IV is opened. (A valve in the duct f is considered open when a vehicle is free to move past the valve in the duct).
2. When the vehicle on the first stretch approaches the station, the alternator V is in position for pressure, valve I is open (position 1), valve III is closed (position 2), valve IV is closed (position 2) so that the exhauster slows down the approaching vehicle by reversion of air flow through duct G. When the vehicle reaches the proper position in the interior of the station, i.e., between valves I and III, the flow control valve M is closed, deenergizing the duct and the vehicle stops completely by the action of its automatic brake system. Since valve III is closed (position 2), the exhauster for the second stretch energizes the latter without any interference with the operation of the first stretch.
3. If a vehicle is running on the first stretch while another vehicle is stopped at the first station, flow alternator V is positioned for suction, valve II is closed (position 2), valve III is open (position 1) and valve IV is closed. When a second vehicle approaches the station while a first vehicle still occupies it, the flow is reverted through channel F to stop the second vehicle before it reaches the station. As safety against eventual failure of the flow alternator or the flow control valve M, valve 1 can be opened (position 1) whereupon the exhauster is totally insulated from the propuslion duct. Since the safety valve II is closed (position 2) the vehicle propelling fin h will be subjected to a buffer effect, acting in the same way as the flow reversion.

A vehicle which has stopped at a station is totally insulated from the exhausters by the closed valves II and IV and open valve III. Its start for the second stretch is only possible when valve IV is opened.

I claim:

1. Pneumatic propulsion means for cargo or passenger vehicles comprising tubular means with a substantially planar upper surface, means for supporting said tubular means along a substantially horizontal path above the surface of the ground, track means attached adjacent said upper planar surface of said tubular means for supporting the wheels of a wheeled vehicle, means for establishing an air pressure differential comprising a relatively high pressure region and a relatively low pressure region within said tubular means, said tubular means containing a longitudinal slot along said upper surface thereof, in combination with at least one vehicle having wheel means cooperating with said track means of said tubular means, said vehicle having at least one rod attached thereto extending through said longitudinal slot of said tubular means, propelling means for the vehicle comprising a propelling fin device constructed to substantially fill the cross-sectional area of said tubular means and attached to the portion of said rod extending into said tubular means, said fin thereby separating said relatively high pressure from said low pressure region and thereby driving said fin and its attached vehicle in the direction of lower pressure, a longitudinal flap extending along said slot adapted to substantially completely close said slot, said flap being so constructed and arranged that said flap closes said slot when a pressure differential is established between said interior of said tubular means and the exterior atmosphere, said flap has on edge thereof attached adjacent one end of said longitudinal slot, and extends with its other edge to the opposite side of said slot, said flap being flexible and so constructed and arranged that when a pressure differential is established between the interior of said tubular means and the exterior atmosphere, said flap closes said slot, wherein one of high and low pressure regions in said duct is at atmospheric pressure, and said vehicle comprises means spaced from said fin in the direction of the atmospheric pressure region for opening said slot for the free passage of air therethrough whereby to reduce aerodynamic losses of air flow on said propelling means along said tubular means.

2. Pneumatic propulsion means for cargo or passenger vehicles comprising tubular means with a substantially planar upper surface, means for supporting said tubular means along a substantially horizontal path above the surface of the ground, track means attached adjacent said upper planar surface of said tubular means for supporting the wheels of a wheeled vehicle, means for establishing an air pressure differential comprising a relatively high pressure region and a relatively low pressure region within said tubular means, said tubular means containing a longitudinal slot along said upper surface thereof, in combination with at least one vehicle having wheel means cooperating with said track means of said tubular means, said vehicle having at least one rod attached thereto extending through said longitudinal slot of said tubular means, propelling means for the vehicle comprising a propelling fin device constructed to substantially fill the cross-sectional area of said tubular means to attached to the portion of said rod extending into said tubular means, said fin thereby separating said relatively high pressure region in said tubular means from said low pressure region and thereby driving said fin and its attached vehicle in the direction of lower pressure, a brake system for said wheels of said vehicle, means associated with said propelling fin to operate the brake system when no differential pressure exists on the two sides of said fin and to release said brake system when differential pressure is applied to one side of said fin.

3. Pneumatic propulsion means for cargo or passenger vehicles comprising tubular means with a substantially planar upper surface, means for supporting said tubular means along a substantially horizontal path above the surface of the ground, track means attached adjacent said upper planar surface of said tubular means for supporting the wheels of a wheeled vehicle, means for establishing an air pressure differential comprising a relatively high pressure region and a relatively low pressure region within said tubular means, said tubular means containing a longitudinal slot along said upper surface thereof, in combination with at least one vehicle having wheel means cooperating with said track means of said tubular means, said vehicle having at least one rod attached thereto extending through said longitudinal slot of said tubular means, propelling means for the vehicle comprising a propelling fin device constructed to substantially fill the cross-sectional area of said tubular means and attached to the portion of said rod extending into said tubular means, said fin thereby separating said relatively high pressure region in said tubular means from said low pressure region and thereby driving said fin and its attached vehicle in the direction of lower pressure, at least two stations being located along said tubular means and comprising an air flow alternating device connected to said tubular means, fan means having an inlet and an outlet duct, said inlet and outlet ducts being connected to air flow alternating device whereby suction or superatmospheric pressure may be applied to said tubular means through said air flow alternating device, said air flow alternating device comprising a pair of deflector plates positioned therein adjacent said connections to said inlet and outlet duct of said fan, a flow control valve comprising lever means positioned outside of said air flow alternating device whereby the position of said lever means determines the direction of air pressure applied in said propulsion tubular means.

4. Pneumatic propulsion means for cargo or passenger vehicles comprising tubular means with a substantially planar upper surface, means for supporting said tubular means along a substantially horizontal path above the surface of the ground, track means attached adjacent said upper planar surface of said tubular means for supporting the wheels of a wheeled vehicle, means for establishing an air pressure differential comprising a relatively high pressure region and a relatively low pressure region within said tubular means, said tubular means containing a longitudinal slot along said upper surface thereof, in combination with at least one vehicle having wheel means cooperating with said track means of said tubular means, said vehicle having at least one rod attached thereto extending through said longitudinal slot of said tubular means, propelling means for the vehicle comprising a propelling fin device constructed to substantially fill the cross-sectional area of said tubular means and attached to the portion of said rod extending into said tubular means, said fin thereby separating said relatively high pressure region in said tubular means from said low pressure region and thereby driving said fin and its attached vehicle in the direction of lower pressure, at least two stations being located along said tubular means and comprising an air flow alternating device connected to said tubular means, fan means having an inlet and an outlet duct, said inlet and outlet ducts being connected to said air flow alternating device whereby suction or superatmospheric pressure may be applied to said tubular means through said air flow alternating device, said air flow alternating device having a pair of connecting ducts for connecting it to said propelling tubular means for the vehicle at spaced regions straddling a station for taking on and discharging passengers from the vehicle, valve means adjacent the entrance of each of said pairs of connecting ducts adapted to open or close the same, valve means in said tubular means positioned in the direction of vehicle movement away from the connection of said connecting ducts to said propelling tubular means whereby back pressure from said air flow alternating device may be applied through at least one of said connecting duct by an operator to slow down a vehicle about to arrive at the station.

* * * * *

UNITED STATES PATENT AND TRADEMARK OFFICE

CERTIFICATE OF CORRECTION

PATENT NO. : 4,587,906

DATED : May 13, 1986

INVENTOR(S) : Oskar H.W. Coester

It is certified that error appears in the above-identified patent and that said Letters Patent are hereby corrected as shown below:

Item [54], change the title to read:

--PNEUMATIC PROPULSION SYSTEM FOR CARGO AND PASSENGER VEHICLES--

Signed and Sealed this

*Twenty-ninth* Day of *July 1986*

[SEAL]

*Attest:*

DONALD J. QUIGG

*Attesting Officer*

*Commissioner of Patents and Trademarks*